US009468064B1

(12) United States Patent
Wu et al.

(10) Patent No.: US 9,468,064 B1
(45) Date of Patent: Oct. 11, 2016

(54) LIGHT-EMITTING DIODE DRIVING CIRCUIT AND LIGHT-EMITTING APPARATUS THEREOF

(71) Applicant: Novatek Microelectronics Corp., Hsinchu (TW)

(72) Inventors: Chung-Wen Wu, Yilan County (TW); Sih-Ting Wang, Kaohsiung (TW); Wen-Chi Lin, Yilan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 14/714,360

(22) Filed: May 18, 2015

(51) Int. Cl.
*H05B 33/08* (2006.01)

(52) U.S. Cl.
CPC ..... *H05B 33/0845* (2013.01)

(58) Field of Classification Search
CPC ..... H05B 33/0845; H05B 37/0227; H05B 33/0842; H05B 33/0854; H05B 33/0851; H05B 37/02; H05B 37/029; H05B 33/086; H05B 33/0866; H05B 37/0218; H05B 33/0896; H05B 33/0848; H05B 41/36; H05B 37/00
USPC ..... 315/185 R, 192, 193, 291, 294, 297, 315/299, 300, 301, 302, 307, 308, 312, 361
See application file for complete search history.

(56) References Cited

U.S. PATENT DOCUMENTS

2012/0139968 A1* 6/2012 Adachi ..... G09G 3/3426 345/690

* cited by examiner

*Primary Examiner* — Douglas W Owens
*Assistant Examiner* — Jianzi Chen
(74) *Attorney, Agent, or Firm* — Jianq Chyun IP Office

(57) ABSTRACT

An LED driving circuit and a light-emitting apparatus thereof are provided. The driving circuit includes a voltage providing unit, a voltage setting unit, a current feedback unit and a current dithering unit. The voltage providing unit receives a voltage setting signal and an input voltage to provide an emission driving voltage to a first terminal of an LED string. The voltage setting unit receives an emission feedback signal to provide a voltage setting signal. The current feedback unit provides the emission feedback signal and sequentially receives current setting voltages to sequentially set a driving current flowing through the LED string according to the current setting voltages. The current dithering unit receives the backlight control signal to sequentially provide the current setting voltages.

12 Claims, 3 Drawing Sheets

LIGHT-EMITTING DIODE DRIVING CIRCUIT AND LIGHT-EMITTING APPARATUS THEREOF

BACKGROUND

1. Field of the Invention

The invention is directed to a driving circuit and more particularly, to a light-emitting diode (LED) driving circuit and a light-emitting apparatus thereof.

2. Description of Related Art

A liquid crystal display (LCD) is composed of a liquid crystal panel and a backlight module. The liquid crystal in the liquid crystal panel does not emit light itself, and thus, the liquid crystal panel is lit by means of a surface light source required for displaying which is provided by a light-emitting apparatus in the backlight module, such that the LCD can achieve a display effect. In the control of LED backlight brightness in the related art, the brightness displayed by the backlight module in controlled through pulse modulation or a DC current. Nevertheless, the pulse modulation would cause a power supply load increase, which relatively affect operations of other circuits easily, while the DC control has a smaller driving current variation range, but has difficulty in the brightness control in a wide range.

SUMMARY

The invention provides a light-emitting diode (LED) driving circuit and a light-emitting apparatus thereof capable of reducing current variation of a driving current to have a wide brightness adjustment range and a high brightness resolution.

According to an embodiment of the invention, an LED driving circuit for driving an LED string and including a voltage providing unit, a voltage setting unit, a current feedback unit and a current dithering unit is provided. The voltage providing unit receives a voltage setting signal and an input voltage to provide an emission driving voltage to a first terminal of the LED string. The voltage setting unit is coupled to the voltage providing unit and receives an emission feedback signal to provide the voltage setting signal. The current feedback unit is coupled to the voltage setting unit to provide the emission feedback signal, coupled to a second terminal of the LED string and sequentially receives a plurality of current setting voltages to sequentially set a driving current flowing through the LED string according to the current setting voltages. The current dithering unit receives a backlight control signal to sequentially provide the current setting voltages.

According to an embodiment of the invention, a light-emitting apparatus including an LED string, a voltage providing unit, a voltage setting unit, a current feedback unit and a current dithering unit is provided. The voltage providing unit receives a voltage setting signal and an input voltage to provide an emission driving voltage to a first terminal of the LED string. The voltage setting unit is coupled to the voltage providing unit and receives an emission feedback signal to provide the voltage setting signal. The current feedback unit is coupled to the voltage setting unit to provide the emission feedback signal, coupled to a second terminal of the LED string and sequentially receives a plurality of current setting voltages to sequentially set a driving current flowing through the LED string according to the current setting voltages. The current dithering unit receives a backlight control signal to sequentially provide the current setting voltages.

To sum up, in the LED driving circuit and the light-emitting apparatus thereof provided by the embodiments of the invention, the driving current flowing through the LEDs are sequentially adjusted according to the current setting voltages to increase emission resolution of the LEDs. Thereby, the LEDs have a wide brightness adjustment range and have low current variation of the driving current.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
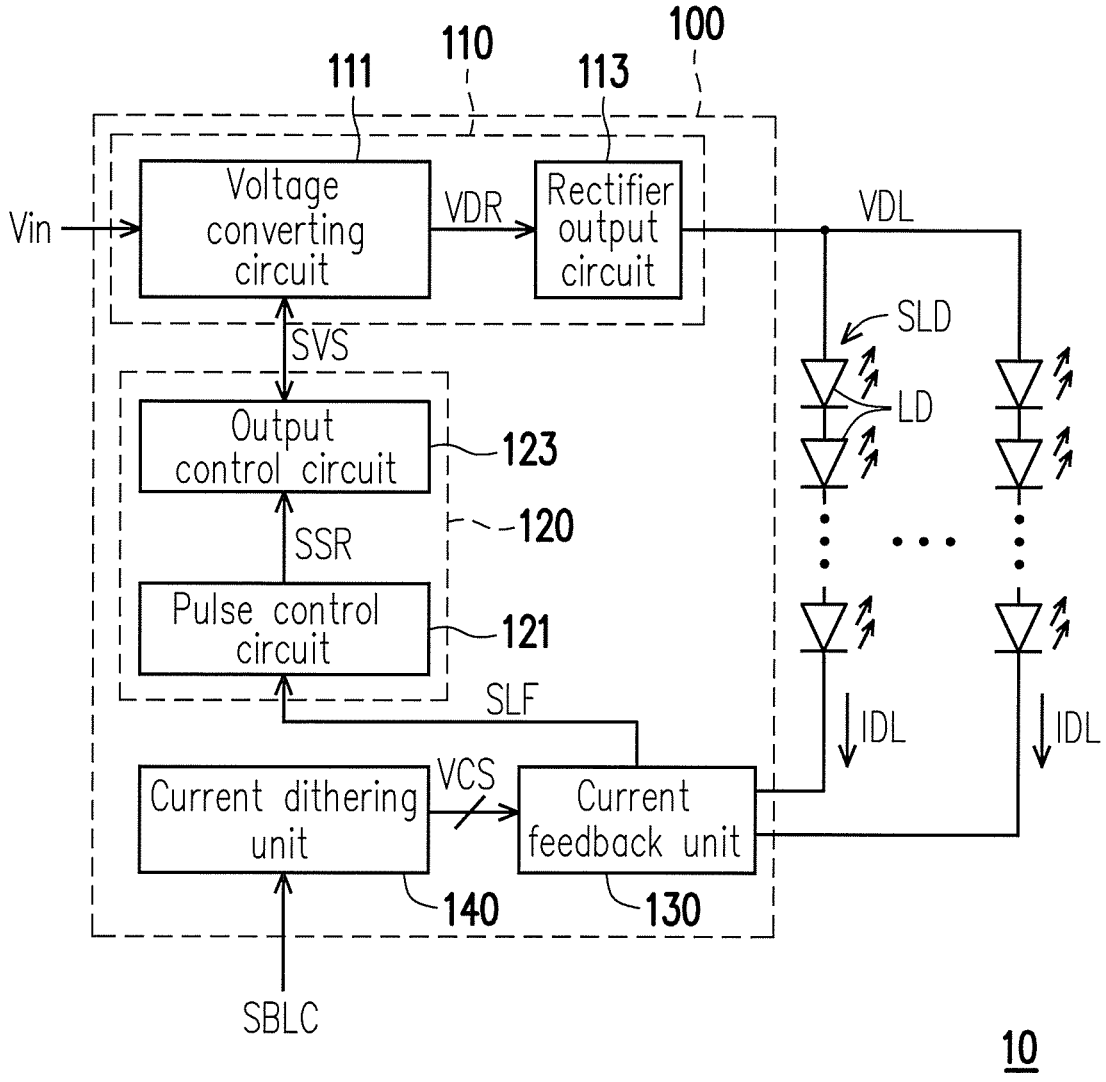
FIG. 1 is a schematic system diagram illustrating a light-emitting apparatus according to an embodiment of the invention.

FIG. 1 is a schematic system diagram illustrating a light-emitting apparatus according to an embodiment of the invention. Referring to FIG. 1, in the present embodiment, a light-emitting apparatus 10 includes a plurality of light-emitting diode (LED) strings SLD connected in parallel and a driving circuit 100. The driving circuit 100 includes a voltage providing unit 110, a voltage setting unit 120, a current feedback unit 130 and a current dithering unit 140.

Each of the LED strings SLD is composed of a plurality of LEDs LD. The voltage providing unit 110 receives a voltage setting signal SVS and an input voltage Vin to convert the input voltage Vin into an emission driving voltage VDL according to the voltage setting signal SVS and provide the emission driving voltage VDL to a first terminal of each of the LED strings SLD. The voltage setting unit 120 is coupled to the voltage providing unit 110 and the current feedback unit 130 to receive an emission feedback signal SLF from the current feedback unit 130 and provide the voltage setting signal SVS to the voltage providing unit 110.

The current feedback unit 130 is coupled to second terminals of the LED strings SLD, the voltage setting unit 120 and the current dithering unit 140 to provide the emission feedback signal SLF to the voltage setting unit 120 and sequentially receive a plurality of current setting voltages VCS from the current dithering unit 140. The current feedback unit 130 generates the emission feedback signal SLF according to a driving current IDL flowing through the LED strings SLD and sequentially sets the driving current IDL flowing through the LED strings SLD according to the current setting voltages VCS. The current dithering unit 140 receives a backlight control signal SBLC to sequentially provide the current setting voltages VCS according to the backlight control signal SBLC.

In the embodiment of the invention, the current setting voltages VCS may correspond to one of a plurality of backlight brightness values, or two adjacent backlight brightness values among the backlight brightness values. When the current setting voltages VCS correspond to one of the backlight brightness values, the driving current IDL presents a DC current, i.e., a load of the voltage providing unit 110 is reduced. When the current setting voltages VCS correspond to two adjacent backlight brightness values among the backlight brightness values, the driving circuit 100 may increase an emission resolution of the LED strings SLD through current dithering by the driving current IDL, and due to a dithering current amplitude being smaller than or equal to a difference between current values corresponding to the two adjacent backlight brightness values, the load of the voltage providing unit 110 is not dramatically increased.

In the present embodiment, the voltage providing unit 110 includes a voltage converting circuit 111 and a rectifier output circuit 113. The voltage converting circuit 111 receives the input voltage Vin and the voltage setting signal SVS to convert the input voltage Vin into a reference driving voltage VDR according to the voltage setting signal SVS, and the rectifier output circuit 113 correspondingly provides the emission driving voltage VDL after receiving the reference driving voltage VDR. The voltage setting unit 120 includes a pulse control circuit 121 and an output control circuit 123. The pulse control circuit 121 receives the emission feedback signal SLF to correspondingly provide a reference control signal SSR, and the output control circuit 123 correspondingly provides the voltage setting signal SVS after receiving the reference control signal SSR.

Figure 2A:
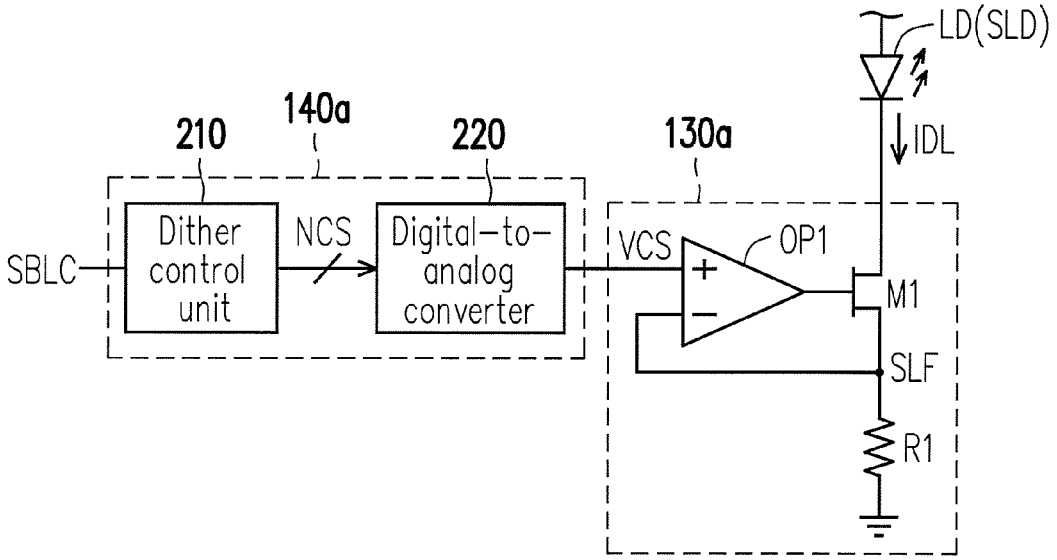
FIG. 2A is a schematic circuit diagram illustrating a current dithering unit and a current feedback unit according to an embodiment of the invention.

FIG. 2A is a schematic circuit diagram illustrating a current dithering unit and a current feedback unit according to an embodiment of the invention. Referring to FIG. 1 and FIG. 2A, in the present embodiment, the backlight control signal SBLC is configured to, for example, transmit a digital value, and the current dithering unit 140*a* includes a dither control unit 210 and a digital-to-analog converter 220.

The dither control unit 210 receives the backlight control signal SBLC and has a plurality of current setting values NCS corresponding to a plurality of backlight brightness values. A bit number (e.g., 10 bits) of the backlight control signal SBLC is greater than a bit number of the current setting values NCS (e.g., 8 bits). A bit number difference between the backlight control signal SBLC and the current setting values NCS is represented by time. A 2-bit bit number difference may be represented by 4 (which is equal to $2^2$) cycles.

Accordingly, the dither control unit 210 compares a set brightness value of the backlight control signal SBLC with the backlight brightness values of the dither control unit 210, so as to determine to continuously output one of the current setting values NCS within a backlight setting period, or alternatively output two adjacent current setting values NCS among the current setting values NCS within the backlight setting period.

The digital-to-analog converter 220 is coupled to the dither control unit 210 to convert the current setting values NCS into the current setting voltages VCS to provide the current setting voltages VCS to the current feedback unit 130.

On the other hand, the current feedback unit 130*a* includes an operational amplifier OP1, a first transistor M1 and a first resistor R1. A positive input terminal (corresponding to a first input terminal) of the operational amplifier OP1 receives the current setting voltages VCS, and an output terminal of the operational amplifier OP1 is coupled to a gate (corresponding to a control terminal) of the first transistor M1. A drain (corresponding to a first terminal) of the first transistor M1 is coupled to the second terminal of the LED string SLD. A source (corresponding to a second terminal) of the first transistor M1 is coupled to a negative terminal (corresponding to a second input terminal) of the operational amplifier OP1. The first resistor R1 is coupled between the source of the first transistor M1 and a ground voltage and configured to provide the emission feedback signal SLF.

Figure 2B:
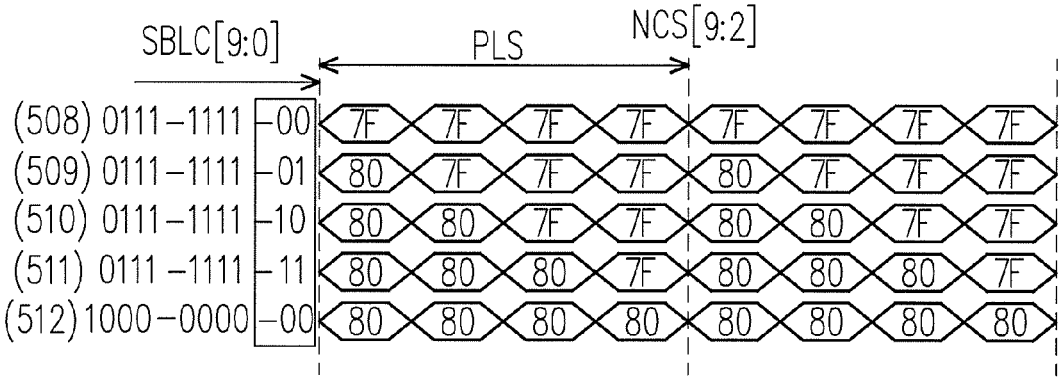
FIG. 2B is a schematic chart illustrating a corresponding relationship between the backlight control signal and the current setting values according to an embodiment of the invention.
Figure 2C:
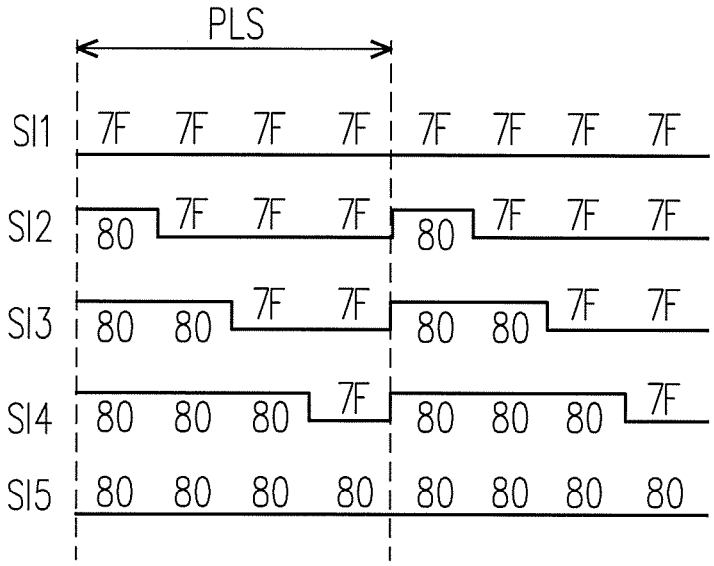
FIG. 2C is a schematic chart illustrating a corresponding relationship between the current setting values and the driving circuit according to an embodiment of the invention.

FIG. 2B is a schematic chart illustrating a corresponding relationship between the backlight control signal and the current setting values according to an embodiment of the invention. FIG. 2C is a schematic chart illustrating a corresponding relationship between the current setting values and the driving circuit according to an embodiment of the invention. Referring to FIG. 2A to FIG. 2C, in the present embodiment, it is assumed that a bit number of the backlight control signal SBLC is 10 bits, a bit number of the current setting values NCS is 8 bits, and a bit number difference of two bits between the backlight control signal SBLC and the current setting values NCS is represented by 4 (i.e., $2^2$) cycles, i.e., 4 cycles serve as a backlight setting period PLS.

When the backlight control signal SBLC is "0111-1111-00" (which is 508 in decimal), a backlight brightness value represented thereby is about 49.6% (i.e., 508/1024), which is equal to a backlight brightness value (i.e., 127/256) represented by a current setting value "0111-1111" (which is 7F in hexadecimal). Thus, the dither control unit 210 continuously outputs the current setting value "7F" within the backlight setting period PLS. In this case, the driving current IDL presents a DC current, and a current value thereof is corresponding to the current setting value "7F," as illustrated by a waveform SI1.

When the backlight control signal SBLC is "0111-1111-01" (which is 509 in decimal), a backlight brightness value represented thereby is about 49.7% (i.e., 509/1024), which is between the backlight brightness value 49.6% (i.e., 127/256) represented by the current setting value of "0111-1111" and a backlight brightness value 50% (i.e., 128/256) represented by a current setting value "1000-0000" (which is 80 in hexadecimal). Thus, the dither control unit 210 alternately outputs the current setting values "7F" and "80" within the backlight setting period PLS. In this case, the driving current IDL presents a pulse wave shape, as illustrated by a waveform SI2, and a time length of the backlight setting period PLS is set with reference to last two digits of the backlight control signal SBLC (i.e., corresponding to the bit number difference). In other words, the current value is set as corresponding to the current setting value "7F" within 3 (i.e., $2^2-0\times2^1\times2^0$)cycles and set as corresponding to the current setting value "80" within 1 (i.e., $0\times2^1+1\times2^0$) cycle.

When the backlight control signal SBLC is "0111-1111-10" (which is 510 in decimal), a backlight brightness value represented thereby is about 49.8% (i.e., 510/1024), which is between the backlight brightness value 49.6% (i.e., 127/256) represented by the current setting value "0111-1111" and the backlight brightness value 50% (i.e., 128/256) represented by the current setting value "1000-0000." Thus, the dither control unit 210 also alternately outputs the current setting values "7F" and "80" within the backlight setting period PLS in the same way. In this case, the driving current IDL presents a pulse wave shape, as illustrated by a waveform SI3. Meanwhile, corresponding to the last two digits of the backlight control signal SBLC, the current value is set as corresponding to the current setting value "7F" within 2 (i.e., $2^2-1\times2^1-0\times2^0$) cycles and set as corresponding to the current setting value "80" within 2 (i.e., $1\times2^1+0\times2^0$) cycles.

When the backlight control signal SBLC is "0111-1111-11" (which is 511 in decimal), a backlight brightness value represented thereby is about 49.9% (i.e., 511/1024), which is between the backlight brightness value 49.6% (i.e., 127/256) represented by the current setting value of "0111-1111" and the backlight brightness value 50% represented by the current setting value "1000-0000." Thus, the dither control unit 210 also alternately outputs the current setting values "7F" and "80" within the backlight setting period PLS. In this case, the driving current IDL presents a pulse wave shape, as illustrated by a waveform SI4. Meanwhile, corresponding to the last two digits of the backlight control signal SBLC, the current value is set as corresponding to the current setting value "7F" within 1 (i.e., $2^2-1\times2^1-1\times2^0$) cycle and set as corresponding to the current setting value "80" within 3 (i.e., $2\times2^1+1\times2^0$) cycles.

When the backlight control signal SBLC is "1000-0000-00" (which is 512 in decimal), a backlight brightness value represented thereby is about 50% (i.e., 512/1024), which is equal to the backlight brightness value (i.e., 128/256) represented by the current setting value "1000-0000." Thus, the dither control unit 210 continuously outputs the current setting value "80" within the backlight setting period PLS. In this case, the driving current IDL presents a DC current, and a current value thereof is corresponding to the current setting value "80," as illustrated by the waveform SI1.

Based on the above, when the set brightness value of the backlight control signal SBLC is equal to one of the backlight brightness values, the dither control unit 210 may continuously output the corresponding current setting value NCS in the backlight setting period PLS; and when the set brightness value of the backlight control signal SBLC is between two adjacent backlight brightness values among the backlight brightness values, the dither control unit 210 alternately outputs two of the current setting values corresponding to the adjacent backlight brightness values in the backlight setting period PLS. Meanwhile, when the set brightness value of the backlight control signal SBLC is an average value of the adjacent backlight brightness values, the numbers of times for outputting the two current setting values NCS corresponding to the adjacent backlight brightness values are the same; and when the set brightness value of the backlight control signal SBLC is close to one of the adjacent backlight brightness values, the number of times for outputting the current setting values NCS corresponding to the closer backlight brightness value is greater than the number of times for outputting the current setting values NCS corresponding to the less close backlight brightness value.

In the embodiments of the invention, besides comparing the backlight brightness values, the dither control unit 210 may also directly output the former 8 bits of the backlight control signal SBLC, and then perform the time period setting according to the later 2 bits of the backlight control signal SBLC, where the time period setting may refer to the description above and will not be repeated. Additionally, based on electrical characteristics of the LEDs, a part of the backlight brightness values having the lower values (e.g., 0% to 10%) may not exist in the dither control unit 210; however, the dither control unit 210 may still output brightness values close to the low brightness value as required by the time period setting, which may be designed by a person with ordinary skills in the art and will not be repeatedly described.

Figure 3:
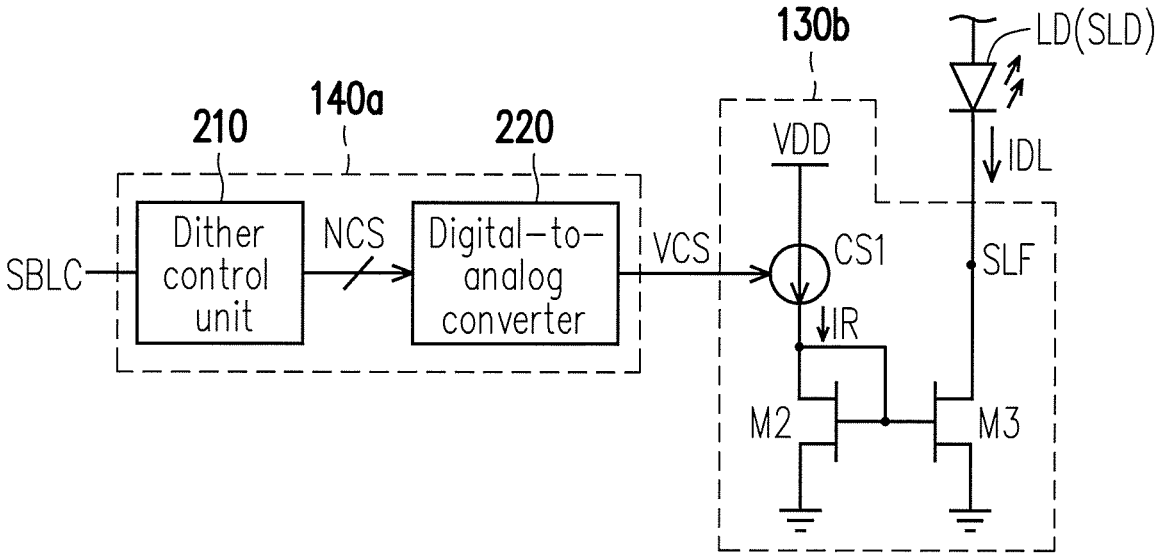
FIG. 3 is a schematic circuit diagram illustrating a current dithering unit and a current feedback unit according to another embodiment of the invention.

FIG. 3 is a schematic circuit diagram illustrating a current dithering unit and a current feedback unit according to another embodiment of the invention. Referring to FIG. 2A and FIG. 3, wherein same or similar reference numbers are used in the drawings and the description to refer to the same or like parts. In the present embodiment, a current feedback unit 130*b* includes a current source CS1, a second transistor M2 and a third transistor M3. The current source CS1 receives a system voltage VDD and sequentially receives the current setting voltages VCS to correspondingly provide a reference current IR. A drain (corresponding to a first terminal) of the second transistor M2 receives a reference current IR, a source (corresponding to a second terminal) of the second transistor M2 is coupled to the ground voltage, and a gate (corresponding to a control terminal) of the second transistor M2 is coupled to the drain of the second transistor M2. A drain (corresponding to a first terminal) of the third transistor M3 is coupled to the second terminal of the LED string SLD, a source (corresponding to a second terminal) of the third transistor M3 is coupled to the ground voltage, and a gate (corresponding to a control terminal) of the second transistor M2 is coupled to the gate of the second transistor M2, wherein the drain of the third transistor M3 provides the emission feedback signal SLF.

In light of the foregoing, the LED driving circuit and the light-emitting apparatus thereof provided by the embodiments of the invention can control the driving current flowing through the LEDs to alternately correspond to two adjacent backlight brightness values, so as to increase the emission resolution of the LEDs. Thereby, the LEDs have a wide brightness adjustment range and has low current variation of the driving current.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A light-emitting diode (LED) driving circuit, for driving an LED string, comprising:

a voltage providing unit, receiving a voltage setting signal and an input voltage to provide an emission driving voltage to a first terminal of the LED string;

a voltage setting unit, coupled to the voltage providing unit and receiving an emission feedback signal to provide the voltage setting signal;

a current feedback unit, coupled to the voltage setting unit to provide the emission feedback signal, coupled to a second terminal of the LED string and sequentially receiving a plurality of current setting voltages to sequentially set a driving current flowing through the LED string according to the current setting voltages; and a current dithering unit, receiving a backlight control signal to sequentially provide the current setting voltages, wherein the current dithering unit comprises:

a dither control unit, receiving the backlight control signal and having a plurality of current setting values corresponding to a plurality of backlight brightness values and comparing a set brightness value of the backlight control signal with the backlight brightness values, so as to determine to continuously output one of the current setting values within a backlight setting period, or alternately output two of the current setting values within the backlight setting period; and a digital-to-analog converter, coupled to the dither control unit to convert the current setting values into the current setting voltages to provide the current setting voltages.

2. The LED driving circuit according to claim 1, wherein the backlight control signal is used for transmitting a digital value, and a bit number of the backlight control signal is greater than a bit number of each of the current setting values.

3. The LED driving circuit according to claim 1, wherein when the set brightness value is equal to one of the backlight brightness values, the dither control unit continuously outputs the corresponding current setting value throughout the backlight setting period, and when the set brightness value is between two adjacent backlight brightness values among the backlight brightness values, the dither control unit alternately outputs two of the current setting values corresponding to the adjacent backlight brightness values throughout the backlight setting period.

4. The LED driving circuit according to claim 3, wherein when the set brightness value is an average value of the adjacent backlight brightness values, the numbers of times for outputting the two current setting values corresponding to the adjacent backlight brightness values are the same, and when the set brightness value is close to one of the adjacent backlight brightness values, the number of times for outputting the current setting value corresponding to the closer backlight brightness value is greater than the number of times for outputting the current setting value corresponding to the less close backlight brightness value.

5. The LED driving circuit according to claim 1, wherein the current feedback unit comprises:

an operational amplifier, having a first input terminal receiving the current setting voltages, a second input terminal and an output terminal;

a first transistor, having a first terminal coupled to the second terminal of the LED string, a second terminal coupled to the second input terminal, and a control terminal coupled to the output terminal; and a first resistor, coupled between the second terminal of the first transistor and a ground voltage and configured to provide the emission feedback signal.

6. The LED driving circuit according to claim 1, wherein the current feedback unit comprises:

a current source, receiving the current setting voltages to correspondingly provide a reference current;

a second transistor, having a first terminal receiving the reference current, a second terminal coupled to a ground voltage and a control terminal coupled to the first terminal of the second transistor; and a third transistor, having a first terminal coupled to the second terminal of the LED string, a second terminal coupled to the ground voltage and a control terminal coupled to the control terminal of the second transistor, wherein the first terminal of the third transistor provides the emission feedback signal.

7. A light-emitting apparatus, comprising:

an LED string;

a voltage providing unit, receiving a voltage setting signal and an input voltage to provide an emission driving voltage to a first terminal of the LED string;

a voltage setting unit, coupled to the voltage providing unit and receiving an emission feedback signal to provide the voltage setting signal;

a current feedback unit, coupled to the voltage setting unit to provide the emission feedback signal, coupled to a second terminal of the LED string and sequentially receiving a plurality of current setting voltages to sequentially set a driving current flowing through the LED string according to the current setting voltages; and a current dithering unit, receiving a backlight control signal to sequentially provide the current setting voltages, wherein the current dithering unit comprises:

a dither control unit, receiving the backlight control signal and having a plurality of current setting values corresponding to a plurality of backlight brightness values and comparing a set brightness value of the backlight control signal with the backlight brightness values, so as to determine to continuously output one of the current setting values within a backlight setting period, or alternately output two of the current setting values within the backlight setting period; and a digital-to-analog converter, coupled to the dither control unit to convert the current setting values into the current setting voltages to provide the current setting voltages.

8. The light-emitting apparatus according to claim 7, wherein the backlight control signal is used for transmitting a digital value, and a bit number of the backlight control signal is greater than a bit number of each of the current setting values.

9. The light-emitting apparatus according to claim 7, wherein when the set brightness value is equal to one of the backlight brightness values, the dither control unit continuously outputs the corresponding current setting value throughout the backlight setting period, and when the set brightness value is between two adjacent backlight brightness values among the backlight brightness values, the dither control unit alternately outputs two of the current setting values corresponding to the adjacent backlight brightness values throughout the backlight setting period.

10. The light-emitting apparatus according to claim 9, wherein when the set brightness value is an average value of the adjacent backlight brightness values, the numbers of times for outputting the two current setting values corresponding to the adjacent backlight brightness values are the same, and when the set brightness value is close to one of the adjacent backlight brightness values, the number of times for outputting the current setting value corresponding to the closer backlight brightness value is greater than the number of times for outputting the current setting value corresponding to the less close backlight brightness value.

11. The light-emitting apparatus according to claim 7, wherein the current feedback unit comprises:

an operational amplifier, having a first input terminal receiving the current setting voltages, a second input terminal and an output terminal;

a first transistor, having a first terminal coupled to the second terminal of the LED string, a second terminal coupled to the second input terminal and a control terminal coupled to the output terminal; and a first resistor, coupled between the second terminal of the first transistor and a ground voltage and configured to provide the emission feedback signal.

12. The light-emitting apparatus according to claim 7, wherein the current feedback unit comprises:

a current source, receiving the current setting voltages to correspondingly provide a reference current;

a second transistor, having a first terminal receiving the reference current, a second terminal coupled to a ground voltage and a control terminal coupled to the first terminal of the second transistor; and a third transistor, having a first terminal coupled to the second terminal of the LED string, a second terminal coupled to the ground voltage and a control terminal coupled to the control terminal of the second transistor, wherein the first terminal of the third transistor provides the emission feedback signal.

* * * * *